US010415321B2

(12) United States Patent
Deel

(10) Patent No.: US 10,415,321 B2
(45) Date of Patent: Sep. 17, 2019

(54) WASHPIPE SEAL ASSEMBLY

(71) Applicant: NABORS INDUSTRIES, INC., Houston, TX (US)

(72) Inventor: Steve Deel, Cypress, TX (US)

(73) Assignee: NABORS INDUSTRIES, INC., Houston, TX (US)

( * ) Notice: Subject to any disclaimer, the term of this patent is extended or adjusted under 35 U.S.C. 154(b) by 479 days.

(21) Appl. No.: 15/165,672

(22) Filed: May 26, 2016

(65) Prior Publication Data

US 2016/0362941 A1 Dec. 15, 2016

Related U.S. Application Data

(60) Provisional application No. 62/173,654, filed on Jun. 10, 2015, provisional application No. 62/268,227, filed on Dec. 16, 2015.

(51) Int. Cl.

| | |
|---|---|
| ***E21B 19/00*** | (2006.01) |
| ***E21B 17/03*** | (2006.01) |
| ***E21B 3/02*** | (2006.01) |

(52) U.S. Cl.

CPC ..... *E21B 17/03* (2013.01); *E21B 3/02* (2013.01); *E21B 19/00* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,608,385 A * | 8/1952 | Stahl | E21B 21/02 | 285/111 |
| 2,676,788 A * | 4/1954 | Davidson | E21B 21/02 | 285/275 |
| 2,764,428 A * | 9/1956 | Murphy | E21B 21/02 | 277/503 |
| 3,736,007 A * | 5/1973 | Heilhecker | E21B 21/02 | 277/322 |
| 5,048,847 A * | 9/1991 | Kovacs | F16J 15/187 | 277/318 |
| 6,923,254 B2 * | 8/2005 | Morrow | E21B 17/05 | 166/88.4 |

* cited by examiner

*Primary Examiner* — Taras P Bemko
*Assistant Examiner* — Ronald R Runyan
(74) *Attorney, Agent, or Firm* — Adolph Locklar

(57) ABSTRACT

A washpipe assembly includes a seal stack including at least one packing ring adapted to seal between a washpipe and the seal housing; a packing spacer ring adapted to maintain spacing between the seal housing and the washpipe, and a guide bushing ring positioned between the packing spacer ring and the washpipe. The guide bushing ring is made from a softer material than the wash pipe such that any contact therebetween will avoid damage to the washpipe. Additionally, the inclusion of the guide bushing ring may allow the packing spacer ring to be offset further from the washpipe than otherwise allowable.

32 Claims, 13 Drawing Sheets

WASHPIPE SEAL ASSEMBLY

CROSS-REFERENCE TO RELATED APPLICATIONS

This application is a nonprovisional application which claims priority from U.S. provisional application No. 62/173,654, filed Jun. 10, 2015, the entirety of which is hereby incorporated by reference. This application also claims priority from U.S. provisional application No. 62/268,227, filed Dec. 16, 2015, the entirety of which is hereby incorporated by reference.

TECHNICAL FIELD/FIELD OF THE DISCLOSURE

The present disclosure relates to seal assemblies for drilling rigs and specifically to washpipe assemblies for drilling rigs.

BACKGROUND OF THE DISCLOSURE

During a drilling operation, fluids are circulated through the drill string from the surface to cool and lubricate the drill bit and flush out cuttings and other matter from the wellbore. The upper end of the rotating drill string is mechanically coupled to the rotating stem of a swivel or top drive. A washpipe assembly allows for a fluid seal between the stationary and nonrotating component of the swivel or top drive known as a gooseneck and the rotating upper end of the drill stem. Typically, the washpipe assembly includes lower and upper seal assemblies coupled by a washpipe which is held stationary by the upper seal assembly. The lower assembly rotates relative to the stationary washpipe and upper seal assembly. The upper and lower seal assemblies typically have one or more packing ring seals adapted to contact the outer surface of the wash pipe and provide sealing therebetween and prevent contact between the washpipe and spacing rings positioned to center the washpipe in the sealing assembly. However, as the packing ring seals are worn away, the wash pipe may contact one or more spacing rings causing damage to the washpipe or seal assembly and requiring repair of the washpipe assembly. Additionally, traditional washpipe assembly designs require components of the washpipe assembly to be coupled by threaded connections, which may require the use of tools such as sledge hammers to assemble. As washpipe assemblies are often suspended over a drill floor, difficulty in transportation and use of the tools may increase risk of injury to drill rig personnel.

SUMMARY

The present disclosure provides for a washpipe assembly. The washpipe assembly may include a washpipe. The washpipe assembly may include an upper seal assembly. The upper seal assembly may include an upper seal housing and an upper adapter ring. The upper adapter ring may be mechanically coupled to a gooseneck and the upper seal housing. The upper seal housing may include at least one upper packing ring forming a seal between the washpipe and the upper seal housing. The upper seal housing may include at least one upper packing spacer ring positioned between the upper seal housing and the washpipe. The washpipe assembly may include a lower seal assembly including a lower adapter ring and a lower seal housing. The lower adapter ring may be mechanically coupled to a drill stem and the lower seal housing. The lower seal housing may include at least one lower packing ring forming a seal between the washpipe and the lower seal housing. The lower seal housing may include at least one lower packing spacer ring, the lower packing spacer ring positioned between the lower seal housing and the washpipe. The lower seal housing may include at least one guide bushing ring positioned between each lower packing spacer ring and the washpipe.

The present disclosure also provides for a seal assembly for a washpipe assembly. The seal assembly may include a seal housing. The seal housing may include at least one packing ring forming a seal between a washpipe and the seal housing. The seal housing may include at least one packing spacer ring, the packing spacer ring positioned between the seal housing and the washpipe. The seal housing may include at least one guide bushing ring positioned between each packing spacer ring and the washpipe. The seal assembly may include an adapter ring mechanically coupleable to a tubular member and a seal housing.

The present disclosure also provides for a seal stack for a seal assembly of a washpipe assembly. The seal stack may include at least one packing ring forming a seal between a washpipe of the washpipe assembly and the seal housing. The seal stack may include at least one packing spacer ring positioned between the seal housing and the washpipe. The seal stack may include at least one guide bushing ring positioned between each packing spacer ring and the washpipe.

The present disclosure also provides for a washpipe assembly. The washpipe assembly may include a washpipe. The washpipe assembly may include an upper seal assembly. The upper seal assembly may include an upper seal housing including an upper threaded coupler adapted to couple to a gooseneck coupler. The upper seal assembly may include at least one upper packing ring positioned within the upper seal housing forming a seal between the washpipe and the upper seal housing. The upper seal assembly may include at least one upper packing spacer ring positioned within the upper seal housing positioned between the upper seal housing and the washpipe. The washpipe assembly may include a lower seal assembly. The lower seal assembly may include a lower seal housing including a lower threaded coupler mechanically coupleable to a swivel stem. The lower seal assembly may include a packing nut. The lower seal assembly may include at least one lower packing ring positioned within the lower seal housing forming a seal between the washpipe and the lower seal housing. The lower seal assembly may include at least one lower packing spacer ring positioned within the lower seal housing positioned between the lower seal housing and the washpipe. The lower seal assembly may include at least one guide bushing ring positioned between each lower packing spacer ring and the washpipe, wherein the lower packing ring, lower packing spacing ring, and guide bushing ring are retained within the lower seal housing by the packing nut.

The present disclosure also provides for a method for assembling a washpipe assembly. The method may include positioning at least one packing ring, packing spacer ring, and guide bushing ring within a lower seal housing. The method may include threading a packing nut to the lower seal housing. The packing nut may retain the packing ring, packing spacer ring, and guide bushing ring within the lower seal housing. The lower seal housing, packing nut, packing ring, packing spacer ring, and guide bushing may define a lower seal assembly. The method may include inserting a washpipe into the lower seal assembly. The method may include installing an upper seal housing about the washpipe.

The method may include coupling an upper packing spacer ring and upper packer ring to the washpipe. The method may include coupling the upper seal housing to a gooseneck coupler. The method may include coupling the lower seal housing to a swivel stem.

The present disclosure provides for a washpipe assembly. The washpipe assembly may include a washpipe. The washpipe assembly may include an upper seal assembly. The upper seal assembly may include an upper seal housing having an upper threaded coupler mechanically coupleable to a gooseneck coupler. The upper seal housing may include at least one upper packing ring positioned within the upper seal housing forming a seal between the washpipe and the upper seal housing. The upper seal housing may include at least one upper packing spacer ring positioned within the upper seal housing positioned between the upper seal housing and the washpipe. The washpipe assembly may include a lower seal assembly. The lower seal assembly may include a lower seal housing, the lower seal housing including a lower threaded coupler mechanically coupleable to a swivel stem. The lower seal assembly may include at least one lower packing ring positioned within the lower seal housing forming a seal between the washpipe and the lower seal housing. The lower seal assembly may include at least one lower packing spacer ring positioned within the lower seal housing positioned between the lower seal housing and the washpipe. The lower seal assembly may include at least one guide bushing ring positioned between each lower packing spacer ring and the washpipe. The lower seal assembly may include a retaining plate positioned within the lower seal housing. The lower seal assembly may include one or more jacking bolts extending through the lower seal housing and abutting the lower packing spacing ring.

The present disclosure also provides for a method for assembling a washpipe assembly. The method may include positioning at least one packing ring, packing spacer ring, and guide bushing ring within a lower seal housing. The lower seal housing may include one or more jacking bolts. The method may include positioning a retaining plate within the lower seal housing. The method may include engaging the retaining plate with a retaining screw. The retaining screw may retain the packing ring, packing spacer ring, guide bushing ring, and retaining plate within the lower seal housing. The lower seal housing, packing nut, packing ring, packing spacer ring, guide bushing, retaining plate, and retaining screw may define a lower seal assembly. The method may include tightening the one or more jacking bolts to compress the packing ring, packing spacer ring, and guide bushing ring against the retaining plate. The method may include inserting a washpipe into the lower seal assembly. The method may include installing an upper seal housing about the washpipe. The method may include coupling an upper packing spacer ring and upper packer ring to the washpipe. The method may include coupling the upper seal housing to a gooseneck coupler. The method may include coupling the lower seal housing to a swivel stem.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
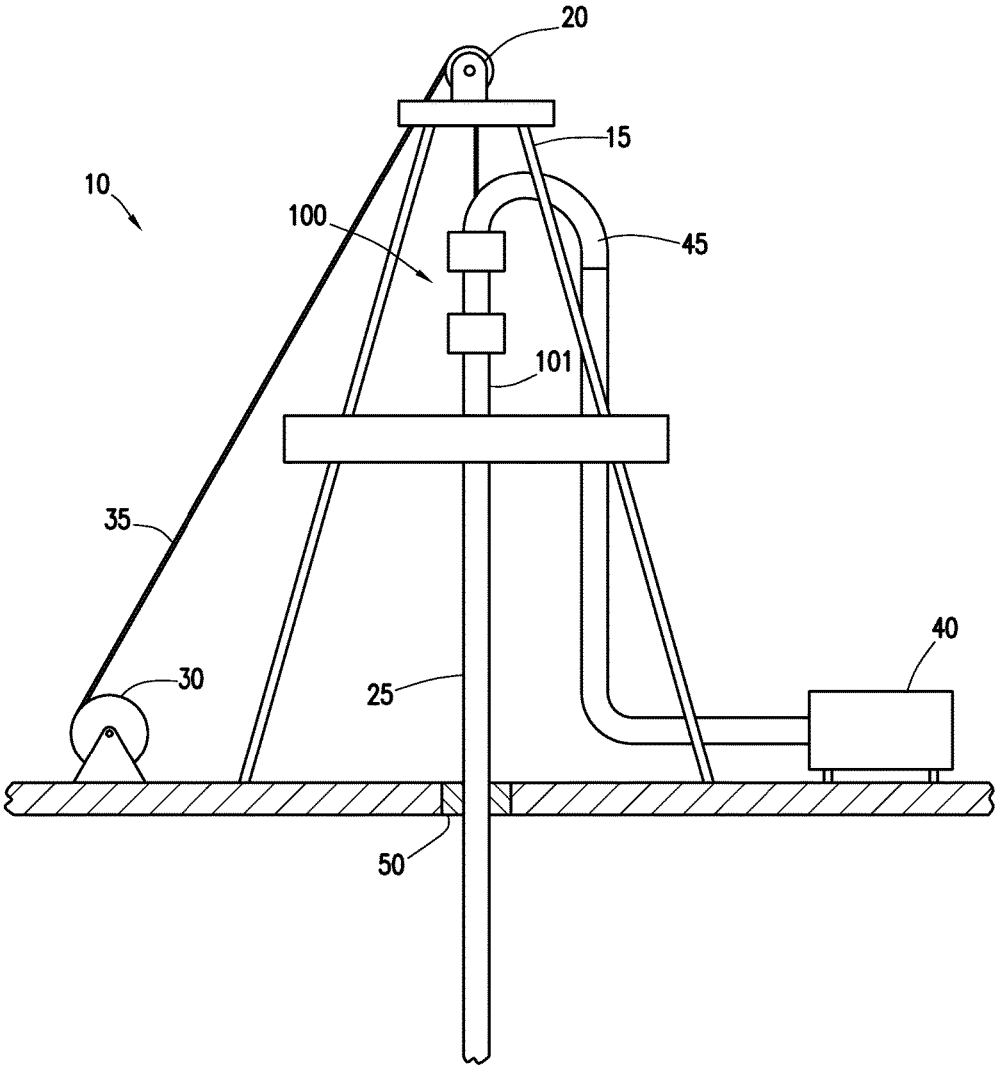
FIG. 1 depicts an overview of a drilling rig utilizing a washpipe assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts an overview of drilling rig 10. Drilling rig 10 may include derrick 15. Derrick 15 may serve to support crown block 20 which is used to hoist drill string 25. Drill string 25 may be hoisted by, for example and without limitation, drawworks 30 by line 35. Drilling rig 10 may further include mud processing equipment 40 which may include, for example and without limitation, a mud pump. Mud processing equipment 40 may pump drilling fluid through gooseneck 45 which is fluidly coupled to drill string 25 by washpipe assembly 100. Drill string 25 may be rotated by a top drive (not shown) or may be rotated by rotary table 50. The upper end of drill string 25 may include a kelly, may be the upper end of the topmost pipe stand of drill string 25, or may be a transfer pipe extending from a top drive. For the purposes of this disclosure, the uppermost rotating portion mechanically coupled to drill string 25 is referred to herein as drill stem 101.

Figure 2:
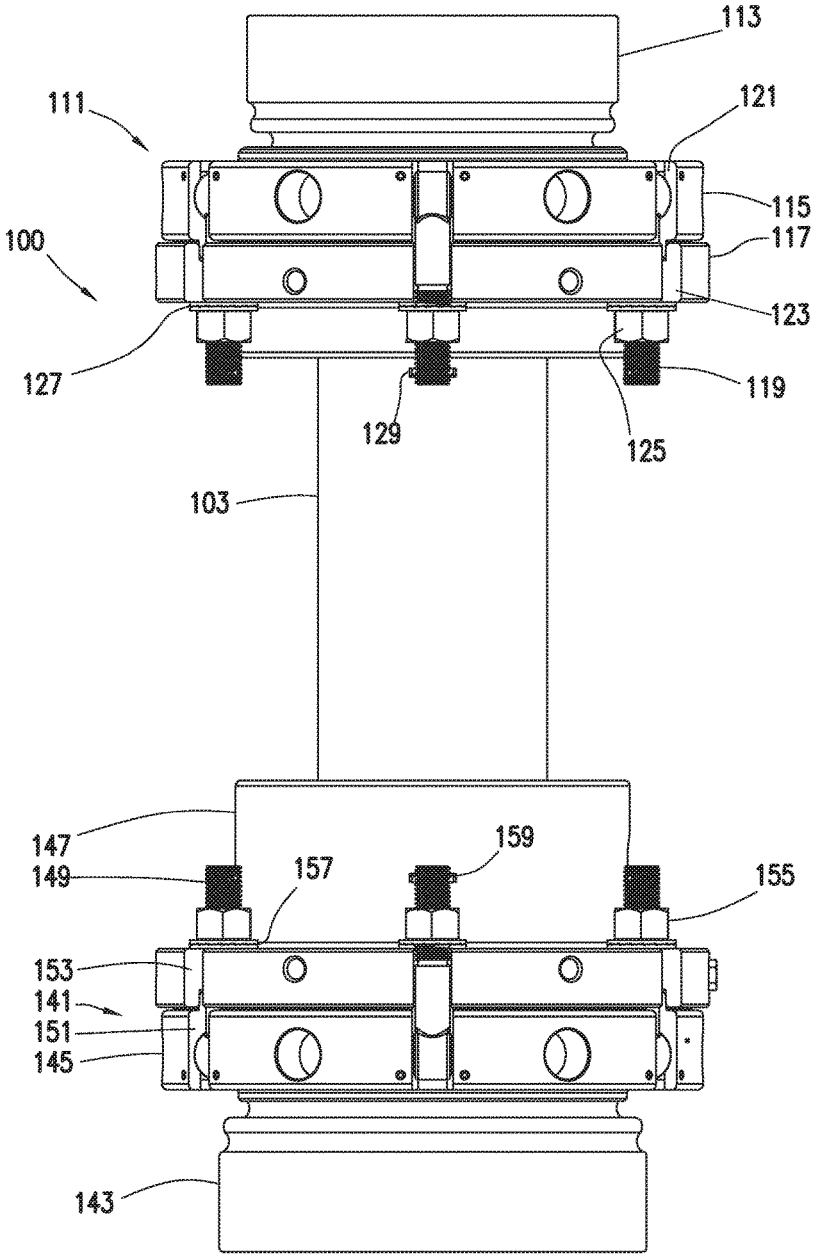
FIG. 2 depicts a side view of a washpipe assembly consistent with at least one embodiment of the present disclosure.
Figure 3:
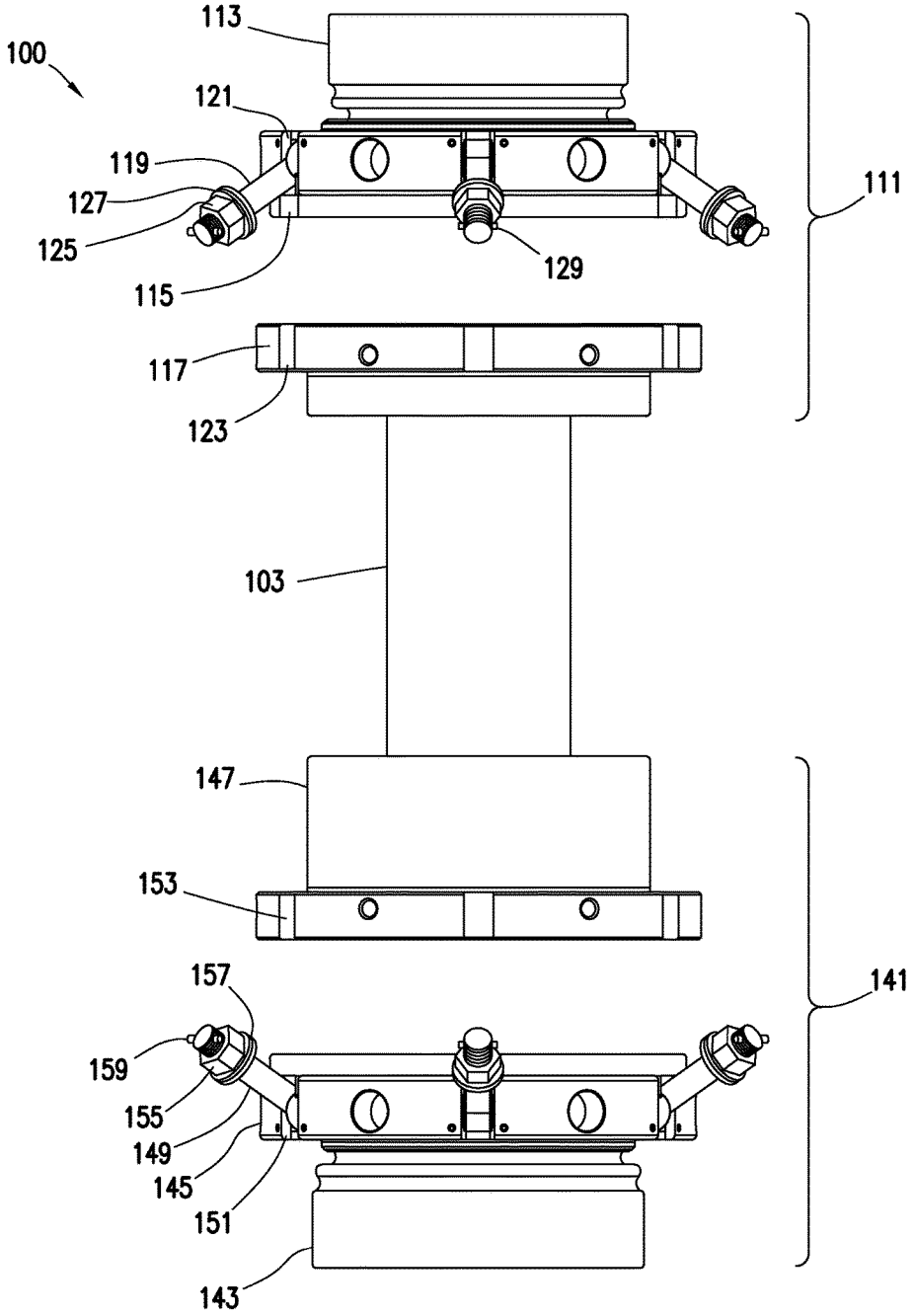
FIG. 3 depicts an exploded view of the washpipe assembly of FIG. 2.

As depicted in FIGS. 2-3, washpipe assembly 100 may include washpipe 103, upper seal assembly 111, and lower seal assembly 141. In some embodiments, washpipe 103 may serve to fluidly couple upper seal assembly 111 and lower seal assembly 141. In some embodiments, washpipe 103 and upper seal assembly 111 are adapted to remain nonrotating as lower seal assembly 141 rotates with drill stem 101 (not shown). In other embodiments, washpipe 103 may rotate with lower seal assembly 141 relative to upper seal assembly 111.

In some embodiments, upper seal assembly 111 may include gooseneck coupler 113, upper adapter ring 115, and upper seal housing 117. Gooseneck coupler 113 may mechanically couple gooseneck 45 to upper adapter ring 115. Gooseneck coupler 113 may be mechanically coupled to gooseneck 45 by, for example and without limitation, a threaded connection, compression or flanged coupler, clip, or mechanical or chemical welding. Although described with respect to a gooseneck, one having ordinary skill in the art with the benefit of this disclosure will understand that upper seal assembly 111 may be utilized with any tubular member.

Upper adapter ring 115 may mechanically couple to upper seal housing 117 such that a fluid seal is formed therebetween as further discussed below. In some embodiments, upper seal housing 117 may mechanically couple to and seal against washpipe 103. In some embodiments, upper adapter ring 115 may mechanically couple to upper seal housing 117 using one or more upper coupler bolts 119. Upper coupler bolts 119 may, in some embodiments, be adapted to extend between slots 121 formed in upper adapter ring 115 and corresponding slots 123 formed in upper seal housing 117. In some embodiments, coupler nuts 125 may be tightened onto coupler bolts 119 (as depicted in FIG. 2) to mechanically couple the faces of upper adapter ring 115 and upper seal housing 117. In some embodiments, lock washers 127 may be positioned between coupler nuts 125 and one or more of upper adapter ring 115 and upper seal housing 117. In some embodiments, upper coupler bolts 119 may be pivotably coupled to upper adapter ring 115 or upper seal housing 117 such that when coupler nuts 125 are loosened, upper coupler bolts 119 may be pivoted out of slots 123 (as depicted in FIG. 3), allowing the separation of upper adapter ring 115 and upper seal housing 117. In some embodiments, one or more nut retention features such as, for example and without limitation, cotter pins 129 may be utilized to restrict complete removal of coupler nuts 125 from upper coupler bolts 119. In some embodiments, upper coupler bolts 119 may be sprung such that when coupler nuts 125 are loosened, upper coupler bolts 119 remain in the extended position depicted in FIG. 3.

In some embodiments, lower seal assembly 141 may include swivel stem 143, lower adapter ring 145, and lower seal housing 147. Swivel stem 143 may mechanically couple drill stem 101 to lower adapter ring 145. Swivel stem 143 may mechanically couple to drill stem 101 by, for example and without limitation, a threaded connection, compression or flanged coupler, clip, or mechanical or chemical welding. Although described with respect to a drill stem, one having ordinary skill in the art with the benefit of this disclosure will understand that lower seal assembly 141 may be utilized with any tubular member.

Lower adapter ring 145 may mechanically couple to lower seal housing 147 such that a fluid seal is formed therebetween as further discussed below. In some embodiments, lower seal housing 147 may mechanically couple to and seal against washpipe 103. In some embodiments, lower adapter ring 145 may mechanically couple to lower seal housing 147 using one or more lower coupler bolts 149. Lower coupler bolts 149 may, in some embodiments, be adapted to extend between slots 151 formed in lower adapter ring 145 and corresponding slots 153 formed in lower seal housing 147. In some embodiments, coupler nuts 155 may be tightened onto coupler bolts 149 (as depicted in FIG. 2) in order to mechanically couple the faces of lower adapter ring 145 and lower seal housing 147. In some embodiments, lock washers 157 may be positioned between coupler nuts 155 and one or more of lower adapter ring 145 and lower seal housing 147. In some embodiments, lower coupler bolts 149 may be pivotably coupled to lower adapter ring 145 or lower seal housing 147 such that when coupler nuts 155 are loosened, lower coupler bolts 149 may be pivoted out of slots 153 (as depicted in FIG. 3), allowing the separation of lower adapter ring 145 and lower seal housing 147. In some embodiments, one or more nut retention features such as, for example and without limitation, cotter pins 159 may be utilized to prevent the full removal of coupler nuts 155 from lower coupler bolts 149. In some embodiments, lower coupler bolts 149 may be sprung such that when coupler nuts 155 are loosened, lower coupler bolts 149 remain in the extended position depicted in FIG. 3.

Figure 4:
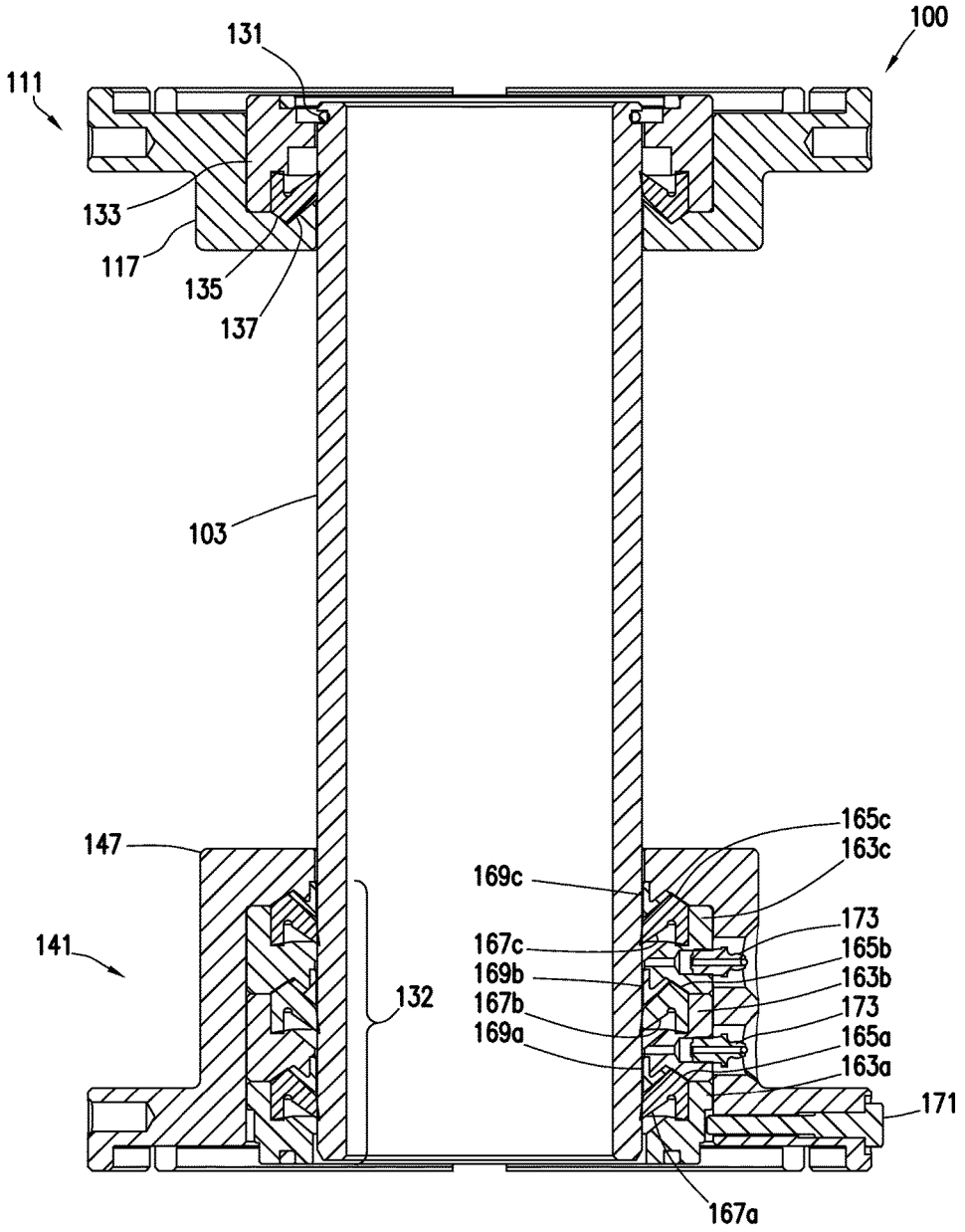
FIG. 4 depicts a cross section of the washpipe assembly of FIG. 2.

FIG. 4 depicts a cross section of the washpipe assembly of FIGS. 2 and 3 with upper adapter ring 115, gooseneck coupler 113, lower adapter ring 145, and swivel stem 143 removed from upper seal assembly 111 and lower seal assembly 141. In some embodiments, upper seal assembly 111 may mechanically couple to washpipe 103 by snap ring 131, although one having ordinary skill in the art with the benefit of this disclosure will understand that washpipe 103 may be mechanically coupled to upper seal assembly 111 by any suitable coupler.

Figure 6:
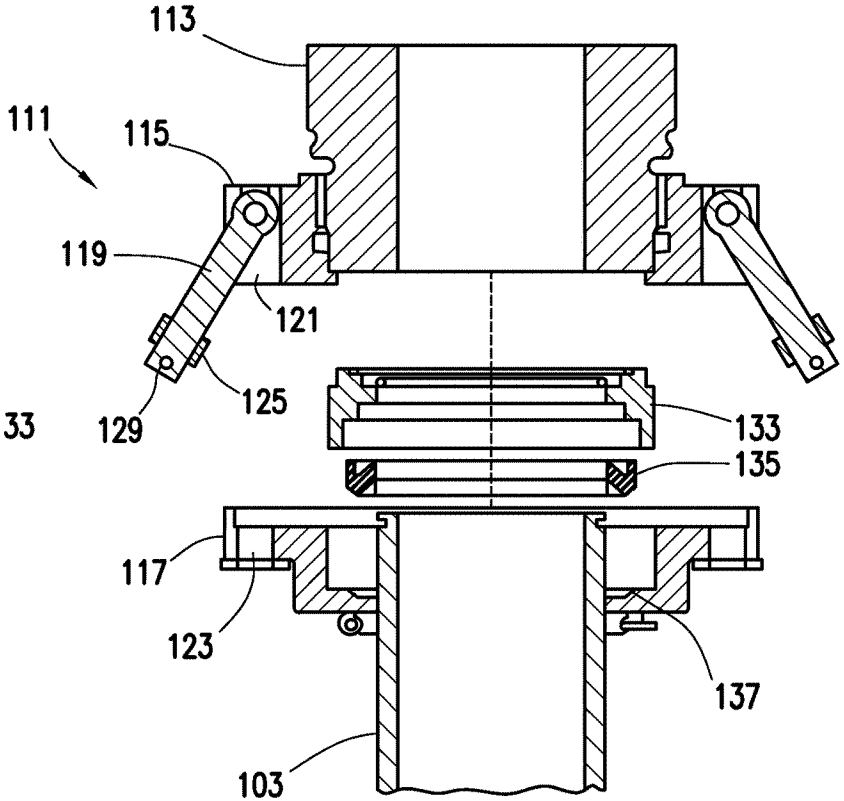
FIG. 6 depicts an exploded view of the upper seal assembly of FIG. 5.
Figure 5:
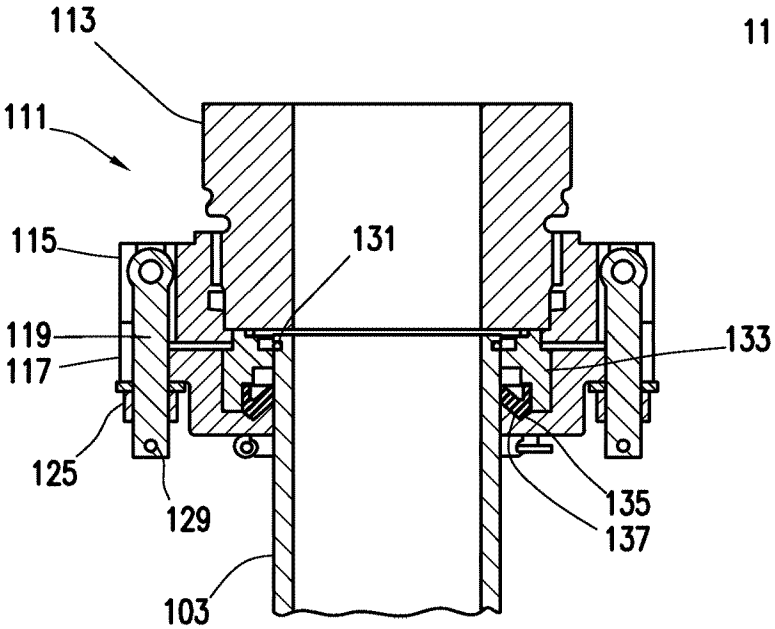
FIG. 5 depicts a cross section of the upper seal assembly of the washpipe assembly of FIG. 2.

As depicted in FIGS. 4-6, upper seal assembly 111, in some embodiments, may include seal stack 132 including at least one upper packing spacer ring 133 and at least one upper packing ring 135 positioned within upper seal housing 117. Upper packing ring 135 may, in some embodiments, form a fluid seal between the outer surface of washpipe 103 and upper seal housing 117. In some embodiments, upper packing ring 135 and upper packing spacer ring 133 may be generally annular in shape. In some embodiments, upper packing ring 135 may be generally chevron-shaped to, for example and without limitation, in response to fluid pressure thereon from the interior of upper seal housing 117, compress against the outer surface of washpipe 103. In some embodiments, upper seal housing 117 may include a corresponding seal surface 137 adapted to retain the shape of upper packing ring 135. In some embodiments, although not depicted, upper seal assembly 111 may include a guide bushing ring between upper seal housing 117 and upper packing ring 135 as discussed herein below. In some embodiments, upper packing spacer ring 133 may mechanically couple between upper seal housing 117 and washpipe 103 to, for example and without limitation, center washpipe 103 within upper seal housing 117. In some embodiments, upper packing spacer ring 133 may mechanically couple to upper seal housing 117 to retain upper packing ring 135 within upper seal housing 117. As depicted in FIG. 6, upper packing spacer ring 133 and upper packing ring 135 may be removed from upper seal housing 117. By disassembling upper seal assembly 111, upper packing spacer ring 133, upper packing ring 135, and any guide bushing (not shown) may be repaired or replaced.

As depicted in FIGS. 4, 7A, 7B, and 8, lower seal assembly 141, may include a seal stack including one or more lower packing spacer rings 163*a-c* and one or more lower packing rings 165*a-c* positioned within lower seal housing 147. Although described as including three lower packing rings 165*a-c*, one having ordinary skill in the art with the benefit of this disclosure will understand that any number of lower packing rings 165*a-c* may be utilized without deviating from the scope of this disclosure. Lower packing rings 165*a-c* may, in some embodiments, form a fluid seal between the outer surface of washpipe 103 and lower seal housing 147. In some embodiments, lower packing rings 165*a-c* and lower packing spacer rings 163*a-c* may be generally annular in shape. In some embodiments, lower packing rings 165*a-c* may be generally chevron-shaped to compress against the outer surface of washpipe 103, for example and without limitation, in response to fluid pressure thereon from the interior of lower seal housing 147. In some embodiments, multiple lower packing rings 165*a-c* may be utilized such that as a lower packing ring (e.g. 165*a*) fails, fluid pressure from within lower seal housing 147 is retained by the next lower packing ring (e.g. 165*b*).

In some embodiments, lower seal housing 147 and lower packing spacer rings 163*a-c* may include a corresponding seal surface 167*a-c* adapted to retain the shape of adjacent lower packing rings 165*a-c*. In some embodiments, lower packing spacer rings 163*a-c* may be adapted to mechanically couple between lower seal housing 147 and washpipe 103 to, for example and without limitation, center washpipe 103 within lower seal housing 147. In some embodiments, lower seal assembly 141 may include guide bushing rings 169*a-c* positioned between lower seal housing 147 or lower packing spacer rings 163*a-c* and adjacent lower packing rings 165*a-c*. Guide bushing rings 169*a-c* may be formed from a softer material than washpipe 103 to avoid damage to washpipe 103 in the case of any contact between washpipe 103 and lower seal assembly 141. Guide bushing rings 169*a-c* may also be positioned closer to the outer surface of washpipe 103 than a metal spacing ring as any contact between washpipe 141 and guide bushing rings 169*a-c* may result in less damage to washpipe 103 and lower seal assembly 141 than the metal-on-metal contact that would otherwise occur. Thus, tighter tolerances than traditional washpipes may be used. Furthermore, lower packing spacer rings 163*a-c*, when formed from a metal, may have a larger inner diameter, further preventing metal-on-metal contact because guide bushing rings 169*a-c* may fill in the space between lower packing spacer rings 163*a-c* and washpipe 103. Thus, wear on lower packing spacer rings 163*a-c* and washpipe 103 may be reduced compared to traditional washpipes. Additionally, because lower packing spacer rings 163*a-c* have a larger inner diameter, the cross section thereof may remain larger and bending moments reduced such that lower packing spacer rings 163*a-c* deflect less under pressure than a traditional bushingless design.

Figure 7B:
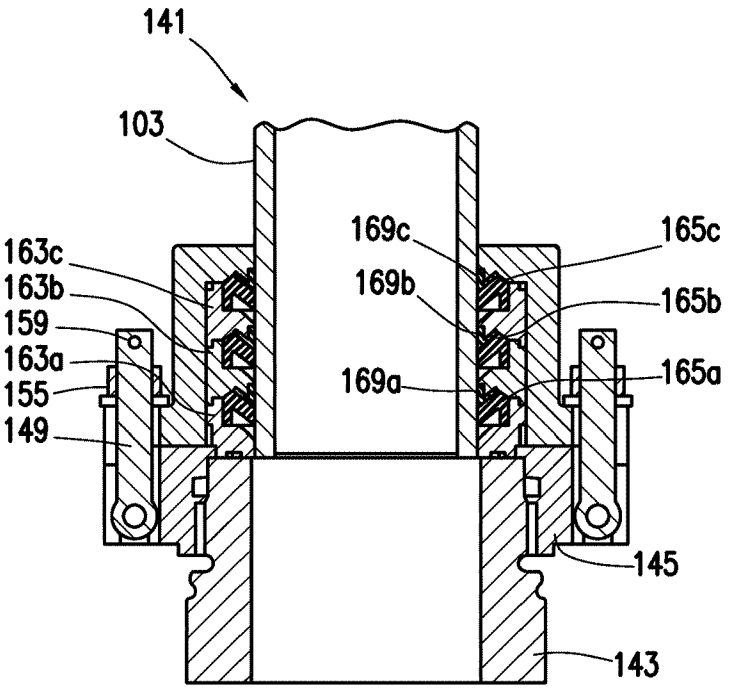
FIGS. 7A, 7B depict cross sections of the lower seal assembly of the washpipe assembly of FIG. 2 taken in two different cutting planes.
Figure 7A:
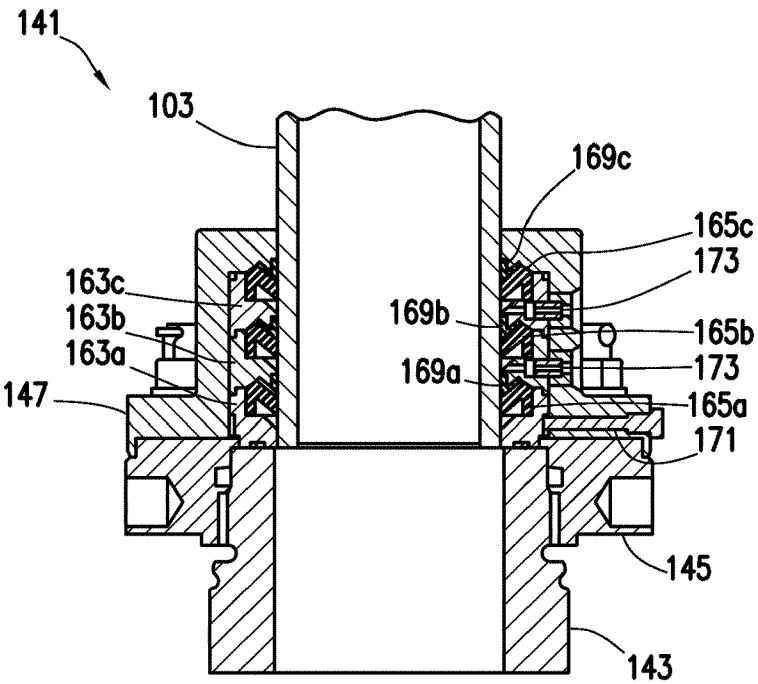
Figure 8:
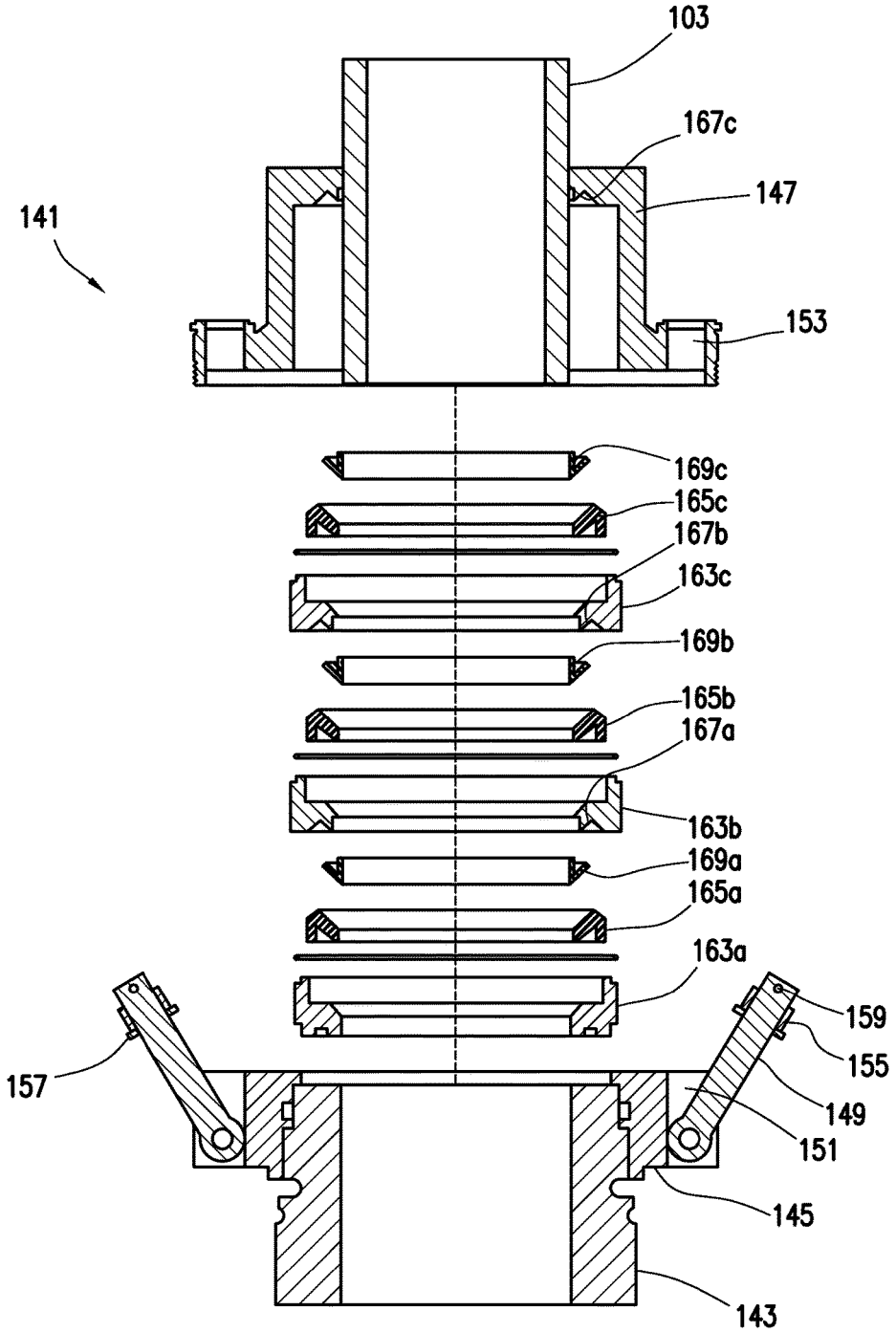
FIG. 8 depicts an exploded view of the lower seal assembly of FIGS. 7A, 7B.

In some embodiments, lower packing spacer rings 163*a-c* may mechanically couple to lower seal housing 147 to retain lower packing ring 165 within lower seal housing 147. As depicted in FIG. 8, lower packing spacer rings 163*a-c*, lower packing rings 165*a-c*, and guide bushing rings 169*a-c* may be removed from lower seal housing 147. By disassembling lower seal assembly 141, lower packing spacer rings 163*a-c*, lower packing rings 165*a-c*, and guide bushing rings 169*a-c* may be repaired or replaced. In some embodiments, as depicted in FIG. 7A, retaining bolt 171 may be positioned to, when tightened into lower seal housing 147, retain lower packing spacer rings 163*a-c*, lower packing rings 165*a-c*, and guide bushing rings 169*a-c* within lower seal housing 147. In some embodiments, when lower adapter ring 145 is mechanically coupled to lower seal housing 147 by lower coupler bolts 139 as depicted in FIG. 7B, lower packing spacer rings 163*a-c*, lower packing rings 165*a-c*, and guide bushing rings 169*a-c* may be retained within lower seal housing 147, allowing retaining bolt 171 to be loosened or removed. In some embodiments, when lower coupler bolts 139 are tightened, lower packing spacer rings 163*a-c*, lower packing rings 165*a-c*, and guide bushing rings 169*a-c* may be compressed such that lower packing rings 165*a-c* contact more tightly against washpipe 103.

In some embodiments, as depicted in FIG. 7A, one or more lubrication ports 173 may be formed in lower seal housing 147 to allow lubricating fluid such as oil or grease to be pumped into the interior of lower seal housing 147 between lower packing rings 165*a-c*.

In some embodiments, by loosening coupler nuts 125, 155 as depicted in FIG. 3, washpipe assembly 100 may be disassembled utilizing hand tools such as a wrench. By loosening coupler nuts 125, 155, upper seal housing 117, lower seal housing 147, and washpipe 103 may be removed from gooseneck 45 and drill stem 101 for, replacement or service. Once removed from upper adapter ring 113 and lower adapter ring 143, upper packing spacer ring 133, upper packing ring 135, lower packing spacer rings 163*a-c*, lower packing rings 165*a-c*, and guide bushing rings 169*a-c* may be removed for repair or replacement. Once complete, upper seal housing 117, lower seal housing 147, and washpipe 103 may be reinstalled to gooseneck 45 and drill stem 101 by retightening coupler nuts 125, 155 to coupler bolts 119, 149 respectively while pivoting coupler bolts 119, 149 into slots 123, 153 respectively utilizing, for example and without limitation, a wrench. Tightening coupler nuts 125, 155 may compress upper packing spacer ring 133, upper packing ring 135, lower packing spacer rings 163*a-c*, lower packing rings 165*a-c*, and guide bushing rings 169*a-c* within the respective upper or lower seal housing 117, 147 as previously described.

Figure 9:
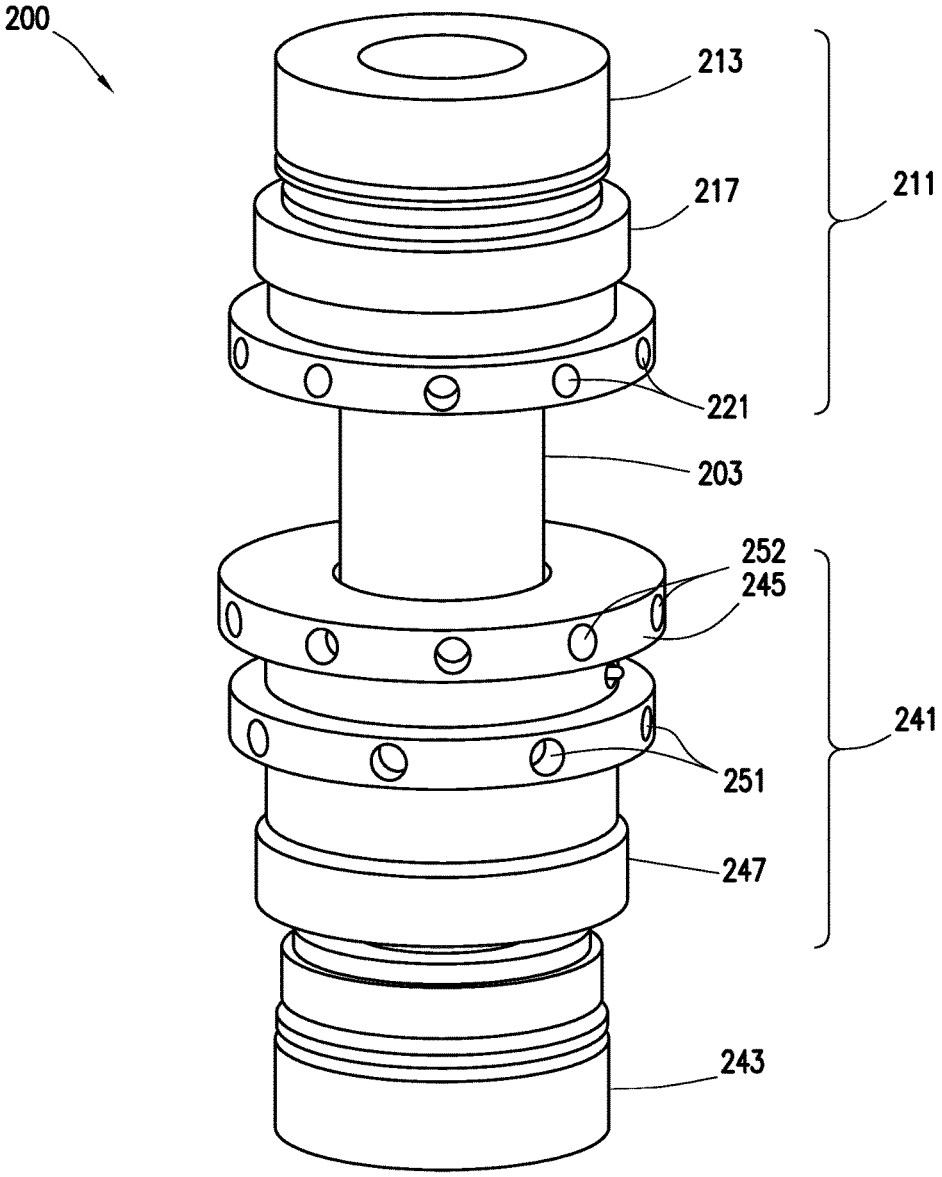
FIG. 9 depicts a perspective view of a washpipe assembly consistent with at least one embodiment of the present disclosure.

In some embodiments, as depicted in FIG. 9, washpipe assembly 200 may include washpipe 203, upper seal assembly 211, and lower seal assembly 241. In some embodiments, washpipe 203 may fluidly couple upper seal assembly 211 and lower seal assembly 241. In some embodiments, washpipe 203 and upper seal assembly 211 may remain nonrotating as lower seal assembly 241 rotates with drill stem 101. In other embodiments, washpipe 203 may rotate with lower seal assembly 241 relative to upper seal assembly 211.

Figure 10:
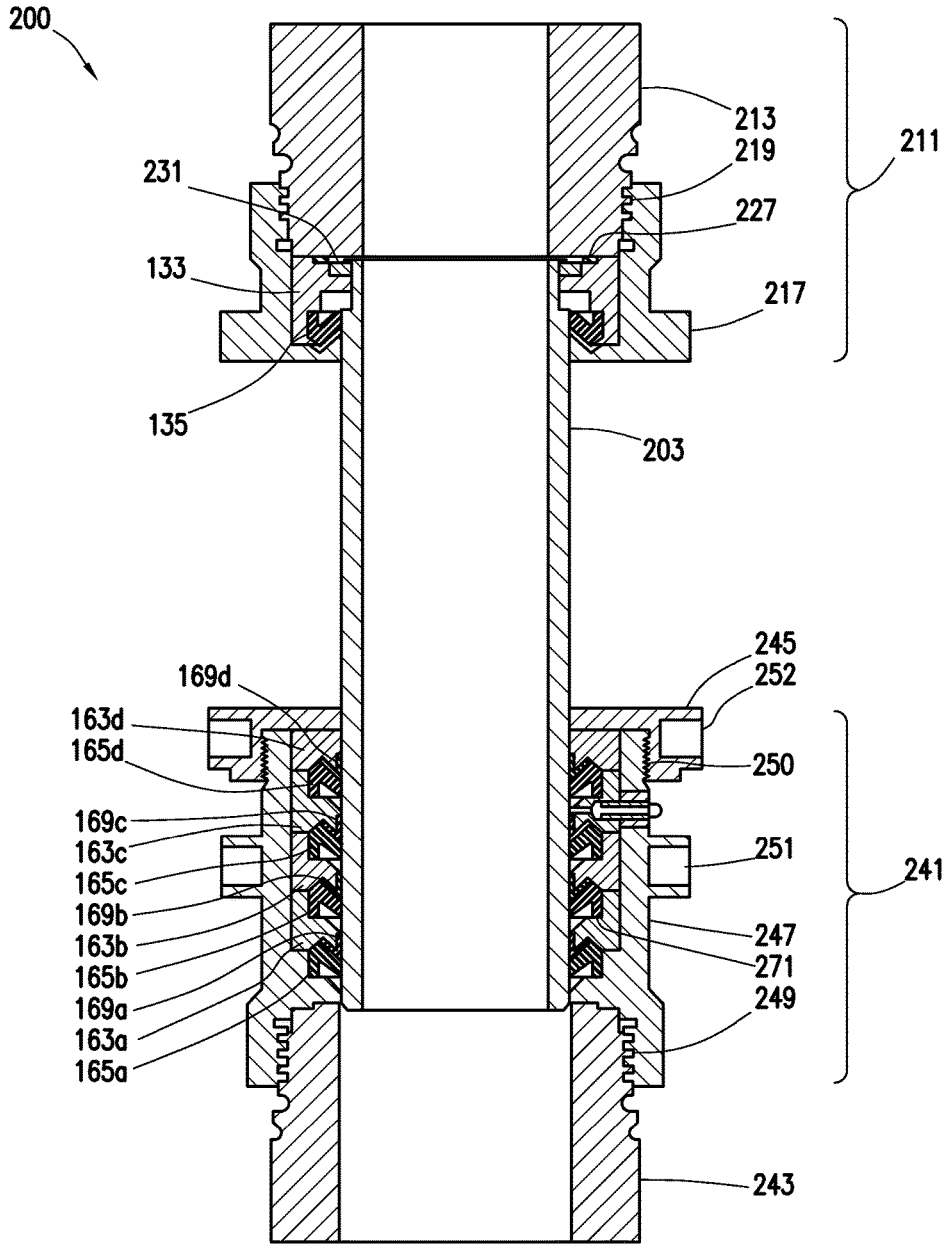
FIG. 10 depicts a cross section view of the washpipe assembly of FIG. 9.

In some embodiments, as depicted in FIG. 10, upper seal assembly 211 may include gooseneck coupler 213, and upper seal housing 217. Gooseneck coupler 213 may mechanically couple gooseneck 45 to upper seal assembly 211. Gooseneck coupler 213 may mechanically couple to gooseneck 45, for example and without limitation, a threaded connection, compression or flanged coupler, clip, or mechanical or chemical welding. Although described with respect to a gooseneck, one having ordinary skill in the art with the benefit of this disclosure will understand that upper seal assembly 211 may be utilized with any tubular member.

In some embodiments, upper seal housing 217 may mechanically couple to and seal against washpipe 203. In some embodiments, upper seal housing 217 may mechanically couple to gooseneck coupler 213 by a threaded connection such as upper threaded coupler 219. In some embodiments, as depicted in FIG. 9, one or more upper tightening holes 221 may be formed in the outer surface of upper seal housing 217 to allow upper seal housing 217 to be tightened onto gooseneck coupler 213 by, for example and without limitation, the use of a bar or spanner (not shown) to turn upper seal housing 217 and engage gooseneck coupler 213 in upper threaded coupler 219.

In some embodiments, as depicted in FIG. 10, upper seal assembly 211 may mechanically couple to washpipe 203 by snap ring 231, although one having ordinary skill in the art with the benefit of this disclosure will understand that washpipe 203 may be mechanically coupled to upper seal assembly 211 by any suitable coupler.

In some embodiments, upper seal assembly 211 may include at least one upper packing spacer ring 133 and at least one upper packing ring 135 positioned within upper seal housing 217 as described herein above with respect to upper seal assembly 111. In some embodiments, upper packing spacer ring 133 and upper packing ring 135 may be retained within upper seal housing 217 by gooseneck coupler 213 as gooseneck coupler 213 is installed to upper threaded coupler 219. In some embodiments, upper packing spacer ring 133 may be pressed therebetween such that gooseneck coupler 213, upper packing spacer ring 133, and upper seal housing 217 are in metal-to-metal contact when gooseneck coupler 213 is mechanically coupled to upper seal housing 217. In some embodiments, one or more seals such as 0-ring 227 may be positioned between upper packing spacer ring 133 and gooseneck coupler 213 to, for example and without limitation, form a fluid seal therebetween. In some embodiments, 0-ring 227 may be square in cross-section.

In some embodiments, lower seal assembly 241 may include swivel stem 243, packing nut 245, and lower seal housing 247. Swivel stem 243 may be adapted to mechanically couple drill stem 101 to lower seal housing 247. Swivel stem 243 may mechanically couple to drill stem 101 by, for example and without limitation, a threaded connection, compression or flanged coupler, clip, or mechanical or chemical welding. Although described with respect to a drill stem, one having ordinary skill in the art with the benefit of this disclosure will understand that lower seal assembly 241 may be utilized with any tubular member.

In some embodiments, lower seal housing 247 may mechanically couple to and seal against washpipe 203. In some embodiments, lower seal housing 247 may mechanically couple to swivel stem 243 by a threaded connection such as lower threaded coupler 249. In some embodiments, as depicted in FIG. 9, one or more swivel stem tightening holes 251 may be formed in the outer surface of lower seal housing 247 to allow lower seal housing 247 to be tightened onto swivel stem 243 by, for example and without limitation, the use of a bar or spanner (not shown) to turn lower seal housing 247 and engage swivel stem 243 in lower threaded coupler 249.

In some embodiments, as depicted in FIG. 10, lower seal housing 247 may mechanically couple to packing nut 245 by a threaded connection such as nut threaded coupler 250. In some embodiments, as depicted in FIG. 9, one or more nut tightening holes 252 may be formed in the outer surface of packing nut 245 to allow packing nut 245 to be tightened onto lower seal housing 247 by, for example and without limitation, the use of a bar or spanner (not shown) to turn packing nut 245 and engage packing nut 245 in nut threaded coupler 250.

In some embodiments, as depicted in FIG. 10, lower seal assembly 241 may include a seal stack including one or more lower packing spacer rings 163*a-d,* one or more lower packing rings 165*a-d,* and one or more guide bushing rings 169*a-d* positioned within lower seal housing 247 as described herein above with respect to the lower packing spacer rings 163*a-c,* lower packing rings 165*a-c,* and guide bushing rings 169*a-c* of lower seal assembly 141. In some embodiments, and as understood by one having ordinary skill in the art with the benefit of this disclosure, any number of lower packing rings, lower packing spacer rings, and guide bushing rings may be utilized without deviating from the scope of this disclosure. In some embodiments, lower packing spacer rings 163*a-d,* lower packing rings 165*a-d,* and guide bushing rings 169*a-d* may be retained within lower seal housing 247 by packing nut 245 as packing nut 245 is installed to lower seal housing 247. In some embodiments, lower packing spacer rings 163*a-d,* lower packing rings 165*a-d,* and guide bushing rings 169*a-d* may be pressed therebetween such that packing nut 245, lower packing spacer rings 163*a-d,* and lower seal housing 247 are in metal-to-metal contact when packing nut 245 is mechanically coupled to lower seal housing 247. In some embodiments, the lowermost lower packing ring 165*a* may fit into a recess formed as a part of lower seal housing 247, referred to herein as packing ring seat 271.

Figure 11C:
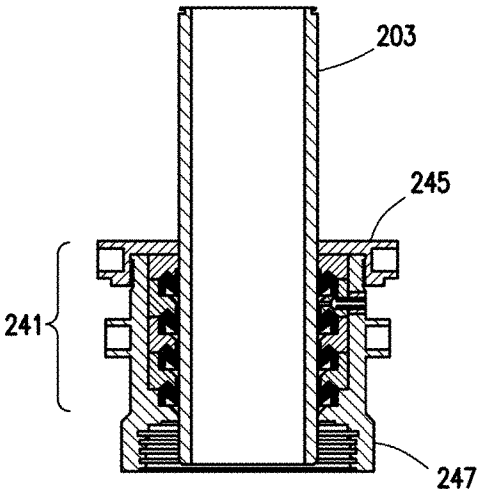
FIGS. 11A-11F depict an exemplary assembly operation of the washpipe assembly of FIG. 9 consistent with at least one embodiment of the present disclosure.

In some embodiments, when installing washpipe assembly 200, washpipe assembly 200 may be partially assembled before it is mechanically coupled to gooseneck coupler 213 and swivel stem 243. FIGS. 11A-F depict an exemplary assembly procedure consistent with at least one embodiment of the present disclosure. Certain reference numbers are omitted or grouped for clarity. The exemplary assembly procedure depicted in FIGS. 11A-F is not intending to be limiting. As depicted in FIG. 11A, lower seal assembly 241 may be assembled by installing any lower packing spacer rings 163*a-d,* lower packing rings 165*a-d,* and guide bushing rings 169*a-d* into lower seal housing 247. In some embodiments, one or more lower packing spacer rings 163*a-d,* lower packing rings 165*a-d,* and guide bushing rings 169*a-d* may be mechanically coupled to each other before installation into lower seal housing 247.

Figure 11B:
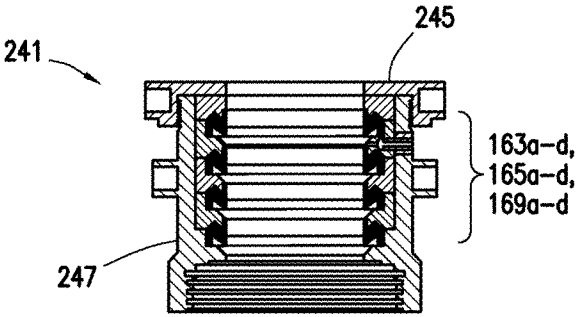
Figure 11A:
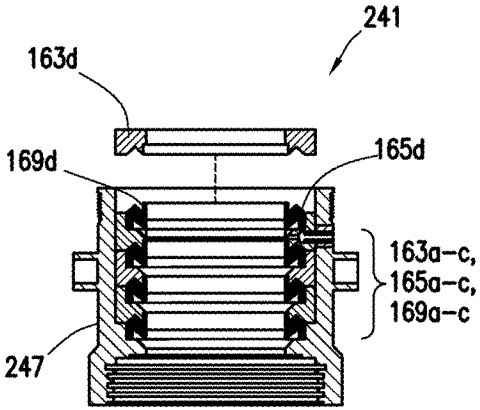

Packing nut 245 may then be installed to lower seal housing 247 as depicted in FIG. 11B. In some embodiments, packing nut 245 may be installed loosely to avoid or minimize compression of lower packing rings 165*a-d* to, for example and without limitation, make further assembly and installation of washpipe assembly 200 more easy.

In some embodiments, washpipe 203 may then be inserted into lower seal assembly 241 as depicted in FIG. 11C.

Figure 11F:
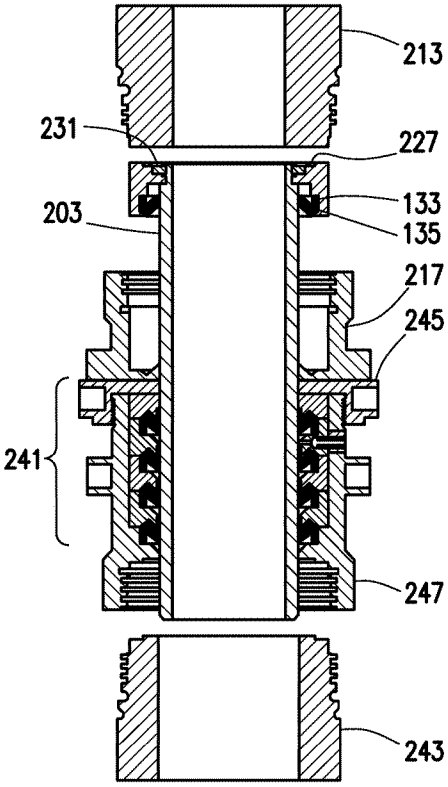
Figure 11E:
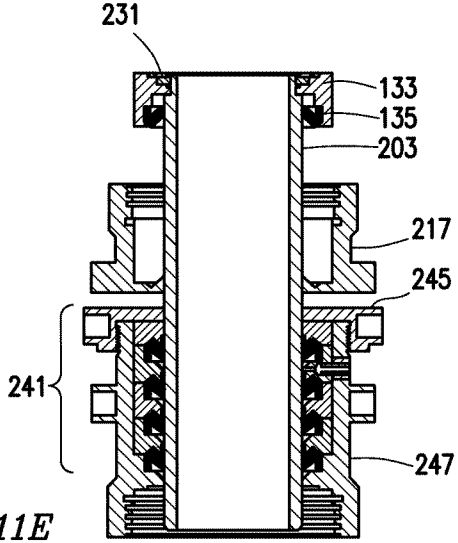
Figure 11D:
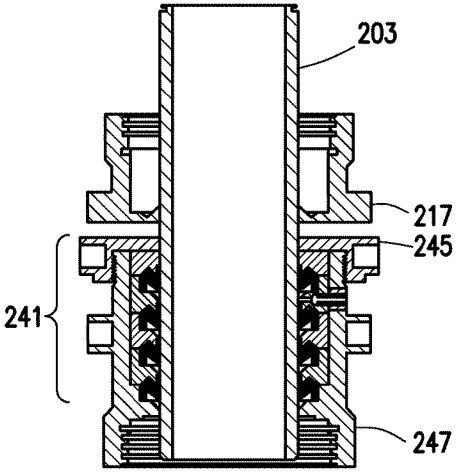

In some embodiments, upper seal housing 217 may be installed about washpipe 203 as depicted in FIG. 11D. Upper packing spacer ring 133 and upper packing ring 135 may be installed about washpipe 203 as depicted in FIG. 11E, and may be retained thereto by snap ring 231. In some embodiments, upper packing spacer ring 133 and upper packing ring 135 may be mechanically coupled to each other before installation onto washpipe 203.

Washpipe assembly 200 may be stored or transported in a partially assembled configuration. In some embodiments, washpipe assembly 200 may be moved to derrick 15 (not shown) and positioned in alignment with gooseneck coupler 213 and swivel stem 243 as depicted in FIG. 11F. Upper seal housing 217 may be mechanically coupled to gooseneck coupler 213, and lower seal housing 247 may be mechanically coupled to swivel stem 243 as described herein above as depicted in FIG. 10. In some embodiments, upper seal housing 217 and lower seal housing 247 may be tightened to gooseneck coupler 213 and swivel stem 243 respectively by utilizing a bar or spanner (not shown) positioned in upper tightening holes 221 and swivel stem tightening holes 251 respectively. In some embodiments, once washpipe assembly 200 is mechanically coupled to gooseneck coupler 213 and swivel stem 243, packing nut 245 may be tightened to lower seal housing 247 as discussed herein above. In some embodiments, packing nut 245 may be tightened to lower seal housing 247 by utilizing a bar or spanner (not shown) positioned in nut tightening holes 252.

Figure 12:
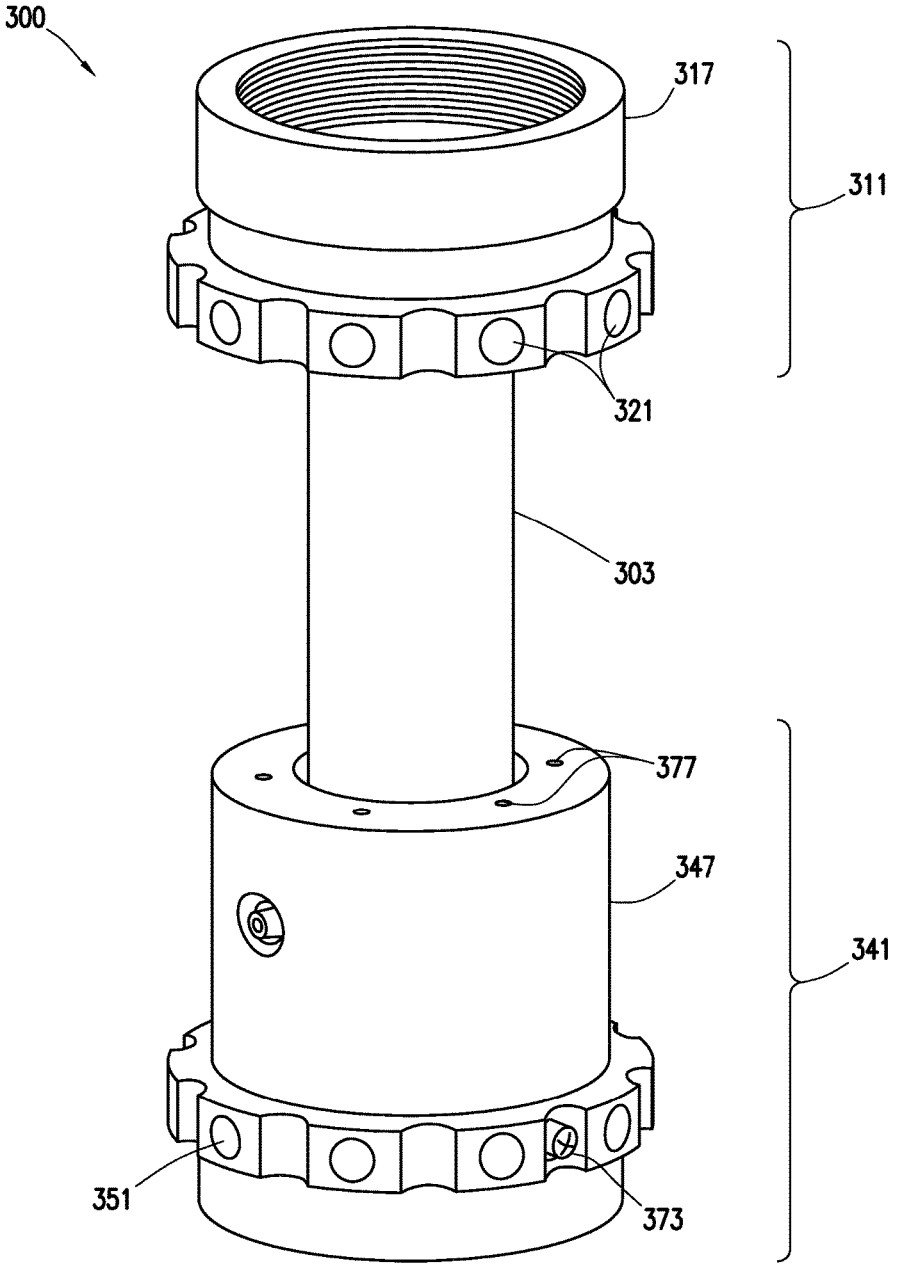
FIG. 12 depicts a perspective view of a washpipe assembly consistent with at least one embodiment of the present disclosure.

In some embodiments, as depicted in FIG. 12, washpipe assembly 300 may include washpipe 303, upper seal assembly 311, and lower seal assembly 341. In some embodiments, washpipe 303 may serve to fluidly couple between upper seal assembly 311 and lower seal assembly 341. In some embodiments, washpipe 303 and upper seal assembly 311 may be adapted to remain nonrotating as lower seal assembly 341 rotates with drill stem 101 (not shown). Although described herein with this arrangement, one having ordinary skill in the art with the benefit of this disclosure will understand that in some embodiments, washpipe 303 may rotate with lower seal assembly 341 relative to upper seal assembly 311.

Figure 13:
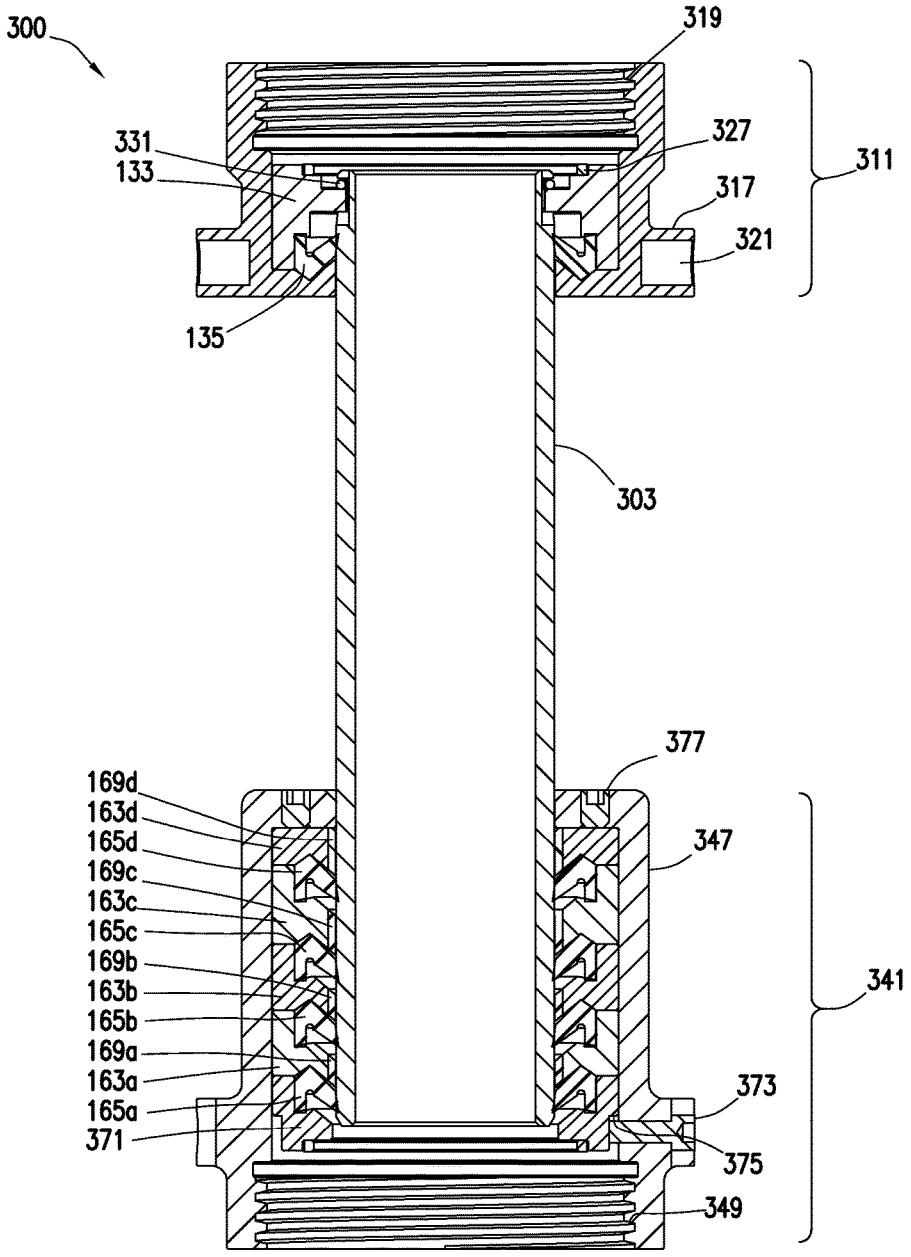
FIG. 13 depicts a cross section view of the washpipe assembly of FIG. 12.

In some embodiments, as depicted in FIG. 13, upper seal assembly 311 may include gooseneck coupler 113 as discussed herein above with respect to other embodiments, and upper seal housing 317. Gooseneck coupler 113 may be adapted to couple gooseneck 45 to upper seal assembly 311. Gooseneck coupler 113 may mechanically couple to gooseneck 45 by, for example and without limitation, a threaded connection, compression or flanged coupler, clip, or mechanical or chemical welding. Although described with respect to a gooseneck, one having ordinary skill in the art with the benefit of this disclosure will understand that upper seal assembly 311 may be utilized with any tubular member.

In some embodiments, upper seal housing 317 may mechanically couple to and seal against washpipe 303. In some embodiments, upper seal housing 317 may mechanically couple to the gooseneck coupler by a threaded connection such as upper threaded coupler 319. In some embodiments, as depicted in FIG. 12, one or more upper tightening holes 321 may be formed in the outer surface of upper seal housing 317 to allow upper seal housing 317 to be tightened onto the gooseneck coupler by, for example and without limitation, the use of a bar or spanner (not shown) to turn upper seal housing 317 and engage the gooseneck coupler in upper threaded coupler 319.

In some embodiments, as depicted in FIG. 13, upper seal assembly 311 may mechanically couple to washpipe 303 by snap ring 331, although one having ordinary skill in the art with the benefit of this disclosure will understand that washpipe 303 may be mechanically coupled to upper seal assembly 311 by any suitable coupler.

In some embodiments, upper seal assembly 311 may include at least one upper packing spacer ring 133 and at least one upper packing ring 135 positioned within upper seal housing 317 as described herein above with respect to upper seal assembly 111. In some embodiments, upper packing spacer ring 133 and upper packing ring 135 may be retained within upper seal housing 317 by gooseneck coupler 113 as gooseneck coupler 113 is installed to upper threaded coupler 319. In some embodiments, upper packing spacer ring 133 may be pressed therebetween such that gooseneck coupler 113, upper packing spacer ring 133, and upper seal housing 317 are in metal-to-metal contact when gooseneck coupler 113 is mechanically coupled to upper seal housing 317. In some embodiments, one or more seals such as O-ring 327 may be positioned between upper packing spacer ring 133 and gooseneck coupler 113 to, for example and without limitation, form a fluid seal therebetween. In some embodiments, O-ring 327 may be square in cross-section.

In some embodiments, lower seal assembly 341 may include swivel stem 243 as discussed herein above with respect to other embodiments. Lower seal assembly 341 may include lower seal housing 347. Swivel stem may mechanically couple drill stem 101 as previously discussed to lower seal housing 347. Swivel stem 243 may mechanically couple to drill stem 101 by, for example and without limitation, a threaded connection, compression or flanged coupler, clip, or mechanical or chemical welding. Although described with respect to a drill stem, one having ordinary skill in the art with the benefit of this disclosure will understand that lower seal assembly 341 may be utilized with any tubular member.

In some embodiments, lower seal housing 347 may mechanically couple to and seal against washpipe 303. In some embodiments, lower seal housing 347 may mechanically couple to swivel stem 243 by a threaded connection such as lower threaded coupler 349. In some embodiments, as depicted in FIG. 12, one or more swivel stem tightening holes 351 may be formed in the outer surface of lower seal housing 347 to allow lower seal housing 347 to be tightened onto the swivel stem by, for example and without limitation, the use of a bar or spanner (not shown) to turn lower seal housing 347 and engage swivel stem 243 in lower threaded coupler 349.

In some embodiments, as depicted in FIG. 13, lower seal assembly 341 may include a seal stack including one or more lower packing spacer rings 163*a-d,* one or more lower packing rings 165*a-d,* and one or more guide bushing rings 169*a-d* positioned within lower seal housing 347 as described herein above with respect to the lower packing spacer rings 163*a-c,* lower packing rings 165*a-c,* and guide bushing rings 169*a-c* of lower seal assembly 141. In some embodiments, and as understood by one having ordinary skill in the art with the benefit of this disclosure, any number of lower packing rings, lower packing spacer rings, and guide bushing rings may be utilized without deviating from the scope of this disclosure.

In some embodiments, lower packing spacer rings 163*a-d,* lower packing rings 165*a-d,* and guide bushing rings 169*a-d* may be retained within lower seal housing 347 by retaining plate 371. Retaining plate 371 may be an annular body and may engage one or both of a lower surface of the lowermost of the lower packing spacer rings, here spacer ring 163*a,* and the lowermost of the lower packing rings, here lower packing ring 165*a*. Retaining screw 373 may, in some embodiments, extend through lower seal housing 347 to engage retaining plate 371 and retain retaining plate 371 within lower seal housing 347. In some embodiments, retaining plate 371 may include lip 375 against which retaining screw 373 engages. In some embodiments, the lowermost lower packing ring 165*a* may fit into a recess formed as a part of retaining plate 371.

In some embodiments, lower seal assembly 341 may include one or more jacking bolts 377. Jacking bolts 377 may extend through holes formed in lower seal housing 347. Jacking bolts 377 may abut the uppermost lower packing spacer ring, here lower packing spacer ring 163*d*. Jacking bolts 377 may, as they are tightened into lower seal housing 347, press downward on lower packing spacer ring 163*d* to compress lower packing spacer rings 163*a-d,* lower packing rings 165*a-d,* and guide bushing rings 169*a-d* between jacking bolts 377 and retaining plate 371.

In some embodiments, two or more jacking bolts 377 may be utilized. In some embodiments, as depicted in FIG. 12, six jacking bolts 377 may be utilized. In some embodiments, jacking bolts 377 may be tightened substantially evenly such that, for example and without limitation, the compression of lower packing spacer rings 163*a-d,* lower packing rings

165*a-d,* and guide bushing rings 169*a-d* between jacking bolts 377 and retaining plate 371 is substantially balanced.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A washpipe assembly comprising:

a washpipe;

an upper seal assembly, the upper seal assembly including an upper seal housing and an upper adapter ring, the upper adapter ring mechanically coupled to a gooseneck and the upper seal housing, the upper seal housing including:

at least one upper packing ring, the upper packing ring forming a seal between the washpipe and the upper seal housing; and at least one upper packing spacer ring, the upper packing spacer ring positioned between the upper seal housing and the washpipe; and a lower seal assembly, the lower seal assembly including a lower adapter ring and a lower seal housing, the lower adapter ring mechanically coupled to a drill stem and the lower seal housing, the lower seal housing including:

at least one lower packing ring, the at least one lower packing ring forming a seal between the washpipe and the lower seal housing;

at least one lower packing spacer ring, the lower packing spacer ring positioned between the lower seal housing and the washpipe; and at least one guide bushing ring positioned between each lower packing spacer ring and the washpipe.

2. The washpipe assembly of claim 1, wherein the lower adapter ring and lower seal housing each comprises a plurality of slots adapted to receive lower coupler bolts to mechanically couple the lower adapter ring and the lower seal housing as coupler nuts are tightened thereonto.

3. The washpipe assembly of claim 2, wherein the lower coupler bolts are pivotably coupled to the lower adapter ring such that they are pivotable into the slots of the lower seal housing.

4. The washpipe assembly of claim 3, wherein the lower coupler bolts are springedly biased into an outer position such that they are not within the slots of the lower seal housing.

5. The washpipe assembly of claim 2, wherein the lower packing ring, lower packing spacer ring, and guide bushing ring are compressed as the lower coupler bolts are tightened.

6. The washpipe assembly of claim 2, further comprising a retention bolt extending through the lower seal housing to retain the lower packing ring, lower packing spacer ring, and guide bushing ring to the lower seal housing until the lower adapter ring is mechanically coupled to the lower seal housing.

7. The washpipe assembly of claim 1, wherein the guide bushing ring is formed from a material softer than the washpipe.

8. A seal assembly for a washpipe assembly comprising:

a seal housing including:

at least one packing ring, the packing ring forming a seal between a washpipe and the seal housing;

at least one packing spacer ring, the packing spacer ring positioned between the seal housing and the washpipe; and at least one guide bushing ring positioned between each packing spacer ring and the washpipe and an adapter ring, the adapter ring mechanically coupleable to a tubular member and the seal housing, the adapter ring and the seal housing each including a plurality of slots adapted to receive coupler bolts to mechanically couple the adapter ring and the seal housing as the coupler nuts are tightened thereonto.

9. The seal assembly of claim 8, wherein the lower coupler bolts are pivotably coupled to the lower adapter ring such that they are pivotable into the slots of the lower seal housing.

10. The seal assembly of claim 9, wherein the lower coupler bolts are springedly biased into an outer position such that they are not within the slots of the lower seal housing.

11. The seal assembly of claim 8, wherein the lower packing ring, lower packing spacer ring, and guide bushing ring are compressed as the lower coupler bolts are tightened.

12. The seal assembly of claim 8, further comprising a retention bolt extending through the lower seal housing to retain the lower packing ring, lower packing spacer ring, and guide bushing ring to the lower seal housing until the lower adapter ring is mechanically coupled to the lower seal housing.

13. The seal assembly of claim 8, wherein the guide bushing ring is formed from a material softer than the washpipe.

14. A washpipe assembly comprising:

a washpipe;

an upper seal assembly, the upper seal assembly including:

an upper seal housing, the upper seal housing including an upper threaded coupler adapted to mechanically couple to a gooseneck coupler;

at least one upper packing ring positioned within the upper seal housing, the upper packing ring forming a seal between the washpipe and the upper seal housing; and at least one upper packing spacer ring positioned within the upper seal housing, the upper packing spacer ring positioned between the upper seal housing and the washpipe;

a lower seal assembly, the lower seal assembly including:

a lower seal housing the lower seal housing including a lower threaded coupler mechanically coupleable to a swivel stem;

a packing nut;

at least one lower packing ring positioned within the lower seal housing, the lower packing ring forming a seal between the washpipe and the lower seal housing;

at least one lower packing spacer ring positioned within the lower seal housing, the lower packing spacer ring positioned between the lower seal housing and the washpipe; and at least one guide bushing ring positioned between each lower packing spacer ring and the washpipe, wherein the lower packing ring, lower packing spacing ring, and guide bushing ring are retained within the lower seal housing by the packing nut.

15. The washpipe assembly of claim 14, wherein the packing nut is threadedly coupled to the lower seal housing, and the packing nut includes one or more nut tightening holes formed on an exterior surface thereof.

16. The washpipe assembly of claim 14, wherein the lower seal housing includes one or more swivel stem tightening holes formed on an exterior surface thereof.

17. The washpipe assembly of claim 14, wherein the upper seal housing includes one or more upper tightening holes formed on an exterior surface thereof.

18. The washpipe assembly of claim 14, further comprising a snap ring positioned to mechanically couple the upper packing spacer ring to the washpipe.

19. A method for assembling a washpipe assembly comprising:

positioning at least one packing ring, packing spacer ring, and guide bushing ring within a lower seal housing;

threading a packing nut to the lower seal housing, the packing nut retaining the packing ring, packing spacer ring, and guide bushing ring within the lower seal housing, the lower seal housing, packing nut, packing ring, packing spacer ring, and guide bushing defining a lower seal assembly;

inserting a washpipe into the lower seal assembly such that each guide bushing ring is positioned between each lower packing spacer ring and the washpipe;

installing an upper seal housing about the washpipe;

coupling an upper packing spacer ring and upper packer ring to the washpipe;

coupling the upper seal housing to a gooseneck coupler; and coupling the lower seal housing to a swivel stem.

20. The method of claim 19, wherein the upper seal housing includes an upper threaded coupler, and coupling the upper seal housing to the gooseneck coupler comprises turning the upper seal housing.

21. The method of claim 19, wherein the lower seal housing includes a lower threaded coupler, and coupling the lower seal housing to the swivel stem comprises turning the lower seal housing.

22. The method of claim 19, wherein threading the packing nut to the lower seal housing comprises partially tightening the packing nut to the lower seal housing, and the method further comprises tightening the packing nut to the lower seal housing.

23. The method of claim 19, wherein coupling the upper packing spacer ring to the washpipe comprises coupling a snap ring between the upper packing spacer ring and the washpipe.

24. A washpipe assembly comprising:

a washpipe;

an upper seal assembly, the upper seal assembly including an upper seal housing, the upper seal housing having an upper threaded coupler mechanically coupleable to a gooseneck coupler, the upper seal housing including:

at least one upper packing ring positioned within the upper seal housing, the upper packing ring forming a seal between the washpipe and the upper seal housing; and at least one upper packing spacer ring positioned within the upper seal housing, the upper packing spacer ring positioned between the upper seal housing and the washpipe; and a lower seal assembly, the lower seal assembly including:

a lower seal housing, the lower seal housing including a lower threaded coupler mechanically coupleable to a swivel stem;

at least one lower packing ring positioned within the lower seal housing, the at least one lower packing ring forming a seal between the washpipe and the lower seal housing;

at least one lower packing spacer ring positioned within the lower seal housing, the lower packing spacer ring positioned between the lower seal housing and the washpipe;

at least one guide bushing ring positioned between each lower packing spacer ring and the washpipe;

a retaining plate positioned within the lower seal housing; and one or more jacking bolts, the jacking bolts extending through the lower seal housing and abutting the lower packing spacing ring.

25. The washpipe assembly of claim 24, further comprising a retaining screw the retaining screw extending through the lower seal housing and engaging the retaining plate.

26. The washpipe assembly of claim 24, wherein the lower seal housing includes one or more swivel stem tightening holes formed on an exterior surface thereof.

27. The washpipe assembly of claim 24, wherein the upper seal housing includes one or more upper tightening holes formed on an exterior surface thereof.

28. The washpipe assembly of claim 24, further comprising a snap ring positioned to mechanically couple the upper packing spacer ring to the washpipe.

29. A method for assembling a washpipe assembly comprising:

positioning at least one packing ring, packing spacer ring, and guide bushing ring within a lower seal housing, the lower seal housing including one or more jacking bolts;

positioning a retaining plate within the lower seal housing;

engaging the retaining plate with a retaining screw, the retaining screw retaining the packing ring, packing spacer ring, guide bushing ring, and retaining plate within the lower seal housing, the lower seal housing, packing nut, packing ring, packing spacer ring, guide bushing, retaining plate, and retaining screw defining a lower seal assembly;

tightening the one or more jacking bolts to compress the packing ring, packing spacer ring, and guide bushing ring against the retaining plate;

inserting a washpipe into the lower seal assembly;

installing an upper seal housing about the washpipe;

coupling an upper packing spacer ring and upper packer ring to the washpipe;

coupling the upper seal housing to a gooseneck coupler; and coupling the lower seal housing to a swivel stem.

30. The method of claim 29, wherein the upper seal housing includes an upper threaded coupler, and coupling the upper seal housing to the gooseneck coupler comprises turning the upper seal housing.

31. The method of claim 29, wherein the lower seal housing includes a lower threaded coupler, and coupling the lower seal housing to the swivel stem comprises turning the lower seal housing.

32. The method of claim 29, wherein coupling the upper packing spacer ring to the washpipe comprises coupling a snap ring between the upper packing spacer ring and the washpipe.

* * * * *